United States Patent [19]

Kurabe et al.

[11] 4,399,858

[45] Aug. 23, 1983

[54] METHOD FOR PRODUCING FOUNDRY MOLD FOR METAL CASTING

[75] Inventors: Hyojiro Kurabe, Fujimi; Akira Muramatsu; Toshisada Makiguchi, both of Tokyo, all of Japan

[73] Assignee: National Research Institute for Metals, Tokyo, Japan

[21] Appl. No.: 240,613

[22] Filed: Mar. 5, 1981

[30] Foreign Application Priority Data

Mar. 5, 1980 [JP] Japan ..... 55-26705

[51] Int. Cl.[3] ..... B22C 9/12; B22C 9/00; B22C 1/18

[52] U.S. Cl. ..... 164/16; 164/12; 164/522; 164/528

[58] Field of Search ..... 164/12, 16, 520, 522, 164/525, 528, 521; 34/36; 106/38.27

[56] References Cited

FOREIGN PATENT DOCUMENTS 52-54501 5/1977 Japan ..... 164/521

55-19462 2/1980 Japan ..... 164/16

*Primary Examiner*—Gus T. Hampilos

*Assistant Examiner*—Jerold L. Johnson

*Attorney, Agent, or Firm*—Wenderoth, Lind & Ponack

[57] ABSTRACT

In a method for producing a mold for metal casting capable of being easily disintegrated by water which comprises the steps of kneading alumina sand with hydrous sodium aluminate as a binder, forming the kneaded mixture into the desired mold shape and then passing carbon dioxide gas through the mold to decompose sodium aluminate and harden it; the improvement wherein the kneading of alumina sand with the binder before mold formation is carried out in an atmosphere of carbon dioxide gas to decompose 50 to 80% of the sodium aluminate in advance.

3 Claims, 1 Drawing Figure

METHOD FOR PRODUCING FOUNDRY MOLD FOR METAL CASTING

Figure 1:
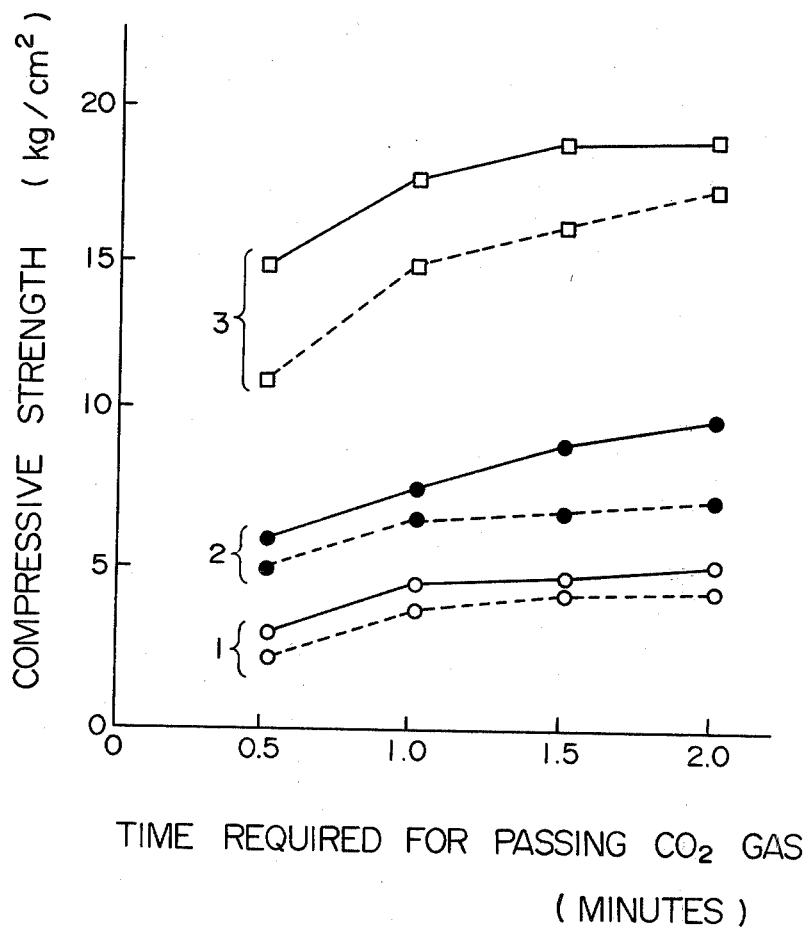

This invention relates to a method for producing a water-soluble mold for metal casting, which is easily hardened by passing $CO_2$ gas therethrough and can be easily disintegrated by water after casting.

Present-day foundries are generally using green molds composed of silica sand and about 7% of bentonite, molds composed of silica and inorganic binders such as water glass and cement, and molds composed of silica sand and several percent of organic binders such as phenolic resins and furan resins. These molds generate noises, vibrations, dusts or offensive odors, although to varying degrees, during a step of mold formation, casting or disintegration, thus causing pollution both in and outside the foundries. In order to solve this problem, the present inventors previously invented a method for producing a water-soluble $CO_2$ gas-set mold capable of being easily formed and easily distintegrated by water after casting, which comprises adding sodium aluminate as a major binder to foundry sand, kneading them, forming the mixture into a desired shape, and hardening the resulting mold by passing $CO_2$ gas therethrough (Japanese Patent Publication No. 27101/1977 now Patent No. 1,013,227).

In the prior invention, the hardening reaction of sodium aluminate as a binder is the decomposition reaction of it with $CO_2$ gas to form $Na_2CO_3$ and $Al(OH)_3$. Accordingly, the decomposition reaction is slow, and a period of more than 5 minutes is required for passing $CO_2$ gas through the mold. Thus, the method of the prior invention has the defect of poor working efficiency, economic disadvantage and low mold strength.

It is an object of this invention therefore to remedy these defects of the prior invention and to provide a method for producing a water-soluble foundry mold having high compressive strength, in which the time required for hardening the mold with $CO_2$ gas is shortened.

The present inventors made investigations in order to achieve the above object, and have found that by performing the kneading of alumina sand and sodium aluminate disclosed in the method of the above-cited Japanese Patent Publication No. 27101/1977 is an atmosphere of $CO_2$ gas to decompose the sodium aluminate partly, the hardening reaction after mold shaping can be completed within a shorter period of time, and a water-soluble mold having high compressive strength can be obtained.

Thus, the present invention provides, in a method for producing a foundry mold for metal casting capable of being easily disintegrated by water, which comprises the steps of kneading alumina sand with hydrous sodium aluminate as a binder, forming the kneaded mixture into the desired mold shape and passing carbon dioxide gas through the mold, the improvement wherein the kneading of the alumina sand and the binder is carried out in an atmosphere of carbon dioxide gas.

Hydrous sodium aluminate used in this invention is generally represented by the formula $nNa_2O.Al_2O_3.mH_2O$. On storage, it is usually liable to be degenerated by the precipitation of alumina gel or sodium aluminate as crystals. Preferably, therefore, the binder is formulated immediately before mold production. If, however, the sodium aluminate has an $Na_2O/Al_2O_3$ mole ratio of from 1.3 to 1.7, preferably from 1.5 to 1.6, and a water content of 45 to 55% by weight, preferably 48 to 52% by weight, it has the advantage that it can be stored without decomposition, and there is no need to formulate the binder immediately before mold production.

If the water content of sodium aluminate is smaller than the specified limit, its viscosity becomes higher, and its kneading with alumina sand is difficult to perform sufficiently. Conversely, if the water content exceeds the specified limit, the strength of the resulting mold is likely to be insufficient.

The sand used as an aggregate in this invention is alumina sand becomes silica sand usually employed in the conventional molds reacts with sodium aluminate at high temperature thereby to form insoluble compounds.

The amount of hydrous sodium aluminate to be mixed is preferably 3 to 10% by weight, especially preferably 5 to 7 parts by weight, per 100 parts by weight of alumina sand. If the amount of the sodium aluminate is less than 3 parts by weight, the compressive strength of the resulting mold is likely to be low. If it exceeds 10 parts by weight, the compressive strength of the resulting mold is likely to be low. If it exceeds 10 parts by weight, the cost of production increases accordingly.

A water-soluble mold can be produced by mixing alumina sand with sodium aluminate as above. However, the rate of reaction between sodium aluminate and $CO_2$ gas is slow, and the time required for passing $CO_2$ gas for mold hardening is more than 5 minutes. This time is much longer than the time (less than 1 minute) required for producing $CO_2$-set molds now used in foundries. The present invention is directed to shortening of the $CO_2$ gas passing time.

The characteristic feature of the present invention is that the kneading of alumina sand with hydrous sodium aluminate is carried out in an atmosphere of carbon dioxide gas, thereby partly decomposing the sodium aluminate prior to mold formation and thus extremely shortening the gas passing time after mold formation. It is desirable that 50 to 80%, preferably 50 to 70%, of the used sodium aluminate be pre-decomposed by the kneading in an atmosphere of carbon dioxide gas.

The term "in an atmosphere of carbon dioxide gas", as used herein, means that a mixture of the alumina sand and the binder is surrounded by a gas containing at least 50% by volume, preferably at least 90% by volume, of carbon dioxide gas.

The kneading in an atmosphere of carbon dioxide gas in accordance with this invention can be conveniently performed by feeding the mixture into a known kneader, such as a batchwise Sympson type mixer used in a foundry, and kneading the mixture while blowing a gas containing carbon dioxide gas, preferably pure carbon dioxide gas, onto the surface of the mixture.

Specifically, alumina sand is first charged into the kneader and then a predetermined amount of sodium aluminate as a binder is added. They are kneaded fully until the surface of the alumina sand is covered with sodium aluminate. Then, in order to perform a partial reaction between sodium aluminate and carbon dioxide, the kneading is continued for about 1 to 5 minutes while blowing carbon dioxide gas against the mixture in the kneader. Since this kneading time is affected by the rotating speed of the kneader or the ambient temperature, it should be determined in consideration of the kneading conditions.

The method of this invention brings about excellent advantages, among which are:

(1) The time required for hardening with $CO_2$ gas after mold formation can be shortened, and the working efficiency for mold hardening increases. Moreover, a water-soluble mold having high compressive strength can be obtained.

(2) By using sodium aluminate of a specified composition, it is not necessary to formulate it immediately before mold formation, and it is possible to store formulated sodium aluminate. This leads to good working efficiency in mold production.

(3) The mold can be disintegated easily by water, and no pollution is caused both in and outside the foundries.

The accompanying drawing is a graph showing an example of improving the efficienty of the carbon dioxide passing operation after mold formation and of increasing the compressive strength of the resulting mold in accordance with this invention. In the graph, the time (minutes) required for passing carbon dioxide gas after mold formation is plotted on the abscissa, and the compressive strength (kg/cm$^2$) of the mold, on the ordinate. Curve group 1 shows the results obtained when the kneading is not performed in an atmosphere of carbon dioxide gas; and curve groups 2 and 3 show the results obtained when the kneading is performed for 1 minute and 2 minutes, respectively, in the carbon dioxide gas atmosphere. The solid lines show the results obtained when the sodium aluminate has an $NaO/Al_2O_3$ mole ratio of 1.5, and the broken lines, the results obtained when this mole ratio is 1.7.

EXAMPLE

One hundred parts by weight of alumina sand (highly pure alumina sand having a size of 70 to 150 mesh) and 5 parts by weight of sodium aluminate ($Na_2O/Al_2O_3$ mole ratio 1.5 or 1.7; water content 50%) were kneaded in a stirrer having an impeller rotating speed of 63 rpm while blowing $CO_2$ gas at a rate of 4 liters/min. The kneading time in an atmosphere of $CO_2$ gas was varied, and the kneaded mixture was formed into molds. The molds were hardened with $CO_2$ gas, and the compressive strengths of the resulting molds were measured. The compressive strength was tested by a sand strength testing machine using a test specimen, 50 mm in diameter and 50 mm in length, in accordance with JIS. The results are shown in the accompanying drawing.

It is seen from the drawing that when the $Na_2O/Al_2O_3$ mole ratio was 1.7 and the kneading was performed for 2 minutes in a $CO_2$ gas atmosphere, a mold having a compressive strength of 15 kg/mm$^2$ was obtained by passing $CO_2$ gas for 1 minute after mold formation. This compressive strength far exceeds the compressive strength required for foundry molds which is about 7 kg/mm$^2$. When the $Na_2O/Al_2O_3$ mole ratio was 1.5, a mold having high compressive strength can be obtained by performing the kneading for 2 minutes in a $CO_2$ gas atmosphere. On the other hand, when the kneading was not performed in $CO_2$ gas, the compressive strength of the resulting mold could be increased only slightly even by prolonging the $CO_2$ gas passing time, and the compressive strength obtained by this invention cannot be attained.

Casting test

Type of castings: an automotive front hub

Weight: 5 kg

Number of castings: 3

Sand: alumina sand of high purity having a size of 70 to 150 mesh

Binder: Sodium aluminate (water content 50%; $Na_2O/Al_2O_3$ mole ratio 1.5)

One hundred parts of alumina sand and 5 parts of sodium aluminate were kneaded in a kneader having a rotating speed of 63 rpm, and finally the kneading was carried out while passing $CO_2$ gas for 2 minutes. The kneaded mixture was formed into a mold, and $CO_2$ gas under 2 kg/cm$^2$ was passed through the mold for 1 minute to harden it.

Cast iron corresponding to FC20 was cast into the resulting mold. The mold was cooled, and then subjected to water-solubilizing treatment by supplying water under a pressure of 1 kg/cm$^2$ at a rate of 10 liters per minute. The mold was easily disintegrated to give a sound casting.

What is claimed is:

1. In a method for producing a mold for metal casting capable of being easily disintegrated by water which comprises the steps of kneading alumina sand with hydrous sodium aluminate as a binder, forming the kneaded mixture into the desired mold shape and then passing carbon dioxide gas through the mold to decompose sodium aluminate and harden it, wherein said hydrous sodium aliminate has an $Na_2O/Al_2O_3$ ratio of from 1.3 to 1.7 and a water content of from 45 to 55% by weight; the improvement wherein the kneading of alumina sand with the binder before mold formation is carried out in an atmosphere of carbon dioxide gas to decompose 50 to 80% of the sodium aluminate prior to forming the kneaded mixture into the desired molded shape.

2. The method of claim 1 wherein the kneading is carried out while blowing pure carbon dioxide gas through the mixture.

3. The method of claim 1 wherein the amount of the hydrous sodium aluminate is from 3 to 10 parts by weight per 100 parts by weight of the alumina sand.

* * * * *